US009593922B2

(12) United States Patent
Carlson et al.

(10) Patent No.: US 9,593,922 B2
(45) Date of Patent: Mar. 14, 2017

(54) FIN DEPLOYMENT SYSTEM

(71) Applicant: BAE Systems Land & Armaments, L.P., Santa Clara, CA (US)

(72) Inventors: Eugene W. Carlson, Elk River, MN (US); Thomas A. Zolen, Vadnais Heights, MN (US); Robert W. Citro, Centerville, MN (US); Kien D. Tran, Brooklyn Park, MN (US)

(73) Assignee: BAE Systems Land & Armaments L.P., Santa Clara, CA (US)

( * ) Notice: Subject to any disclaimer, the term of this patent is extended or adjusted under 35 U.S.C. 154(b) by 438 days.

(21) Appl. No.: 13/828,314

(22) Filed: Mar. 14, 2013

(65) Prior Publication Data

US 2016/0097618 A1 Apr. 7, 2016

(51) Int. Cl.

| | |
|---|---|
| ***F42B 10/16*** | (2006.01) |
| ***F42B 10/26*** | (2006.01) |
| *F42B 10/06* | (2006.01) |
| *F42B 10/30* | (2006.01) |

(52) U.S. Cl.

CPC ..... *F42B 10/16* (2013.01); *F42B 10/06* (2013.01); *F42B 10/26* (2013.01); *F42B 10/30* (2013.01)

(58) Field of Classification Search

CPC ..... F42B 10/12; F42B 10/14; F42B 10/16; F42B 10/20

See application file for complete search history.

(56) References Cited

U.S. PATENT DOCUMENTS

| | | | | |
|---|---|---|---|---|
| 2,793,591 | A * | 5/1957 | Jasse | 244/3.29 |
| 2,858,765 | A * | 11/1958 | Startzell | 244/3.29 |
| 2,924,175 | A * | 2/1960 | Jasse | 244/3.29 |
| 3,853,288 | A * | 12/1974 | Bode | 244/3.29 |
| 4,165,847 | A * | 8/1979 | Detalle | 244/3.29 |
| 4,296,895 | A * | 10/1981 | Pazmany | 244/3.29 |
| 4,607,810 | A * | 8/1986 | Frazer | 244/3.29 |
| 4,778,127 | A * | 10/1988 | Duchesneau | 244/3.29 |
| 5,046,424 | A * | 9/1991 | Skowasch et al. | 102/226 |
| 6,168,111 | B1 * | 1/2001 | Kayser et al. | 244/3.29 |

(Continued)

FOREIGN PATENT DOCUMENTS

| | | |
|---|---|---|
| WO | WO 2012/141641 | 10/2012 |
| WO | WO 2012141641 A1 * | 10/2012 |

OTHER PUBLICATIONS

International Search Report from PCT Application PCT/US2014/023605, dated Dec. 23, 2014, 5 pgs.

(Continued)

*Primary Examiner* — Christopher P Ellis

*Assistant Examiner* — Michael Wang

(74) *Attorney, Agent, or Firm* — Patterson Thuente Pedersen, P.A.

(57) ABSTRACT

A projectile having a fin deployment system disposed about its circumference. The fins are initially contained by a fin cover that is removed by aerodynamic force. The fins are then rotated around a rotational axis parallel to and offset from the central axial axis of the projectile body by the centrifugal forces created by the rotation of the projectile as the projectile passes through a barrel of a gun system or tube launcher. The fin deployment system can also have locking systems that lock the fins in the deployed position and prevent the fins from rotating back into the retracted position after deployment.

19 Claims, 7 Drawing Sheets

(56) References Cited

U.S. PATENT DOCUMENTS

| | | | | |
|---|---|---|---|---|
| 6,739,548 | B1 * | 5/2004 | Bittle et al. | 244/3.29 |
| 6,761,331 | B2 * | 7/2004 | Eisentraut et al. | 244/3.28 |
| 6,796,525 | B2 * | 9/2004 | Johnsson et al. | 244/3.28 |
| 6,978,967 | B1 * | 12/2005 | Scheper et al. | 244/3.24 |
| 7,207,518 | B2 * | 4/2007 | Alculumbre et al. | 244/3.29 |
| 7,226,016 | B2 * | 6/2007 | Johnsson et al. | 244/3.28 |
| 7,642,492 | B2 * | 1/2010 | Parine et al. | 244/3.27 |
| 7,952,055 | B2 * | 5/2011 | Turner et al. | 244/3.28 |
| 8,525,089 | B2 * | 9/2013 | Shin et al. | 244/3.24 |
| 2004/0200375 | A1 | 10/2004 | Kautzsch | |
| 2004/0217227 | A1 | 11/2004 | Alculumbre et al. | |
| 2007/0084961 | A1 | 4/2007 | Johnsson et al. | |
| 2009/0127378 | A1 | 5/2009 | Turner et al. | |
| 2012/0141641 | A1 | 6/2012 | Wells | |

OTHER PUBLICATIONS

International Preliminary Report on Patentability from PCT Application PCT/US2014/023603, dated Sep. 24, 2015, 12 pgs.
Partial Supplementary European Search Report from European Application No. EP14807894.2, dated Sep. 28, 2016, 9 pgs.

* cited by examiner

FIN DEPLOYMENT SYSTEM

FIELD OF THE INVENTION

The present invention is generally directed to a gun or tube launched projectile having a fin deployment system that radially extends a plurality of fins from the projectile body as the projectile leaves the gun barrel or tube launcher. Specifically, the present invention is directed to a deployment system that stores the fins within a cover about the circumference of the projectile then radially deploys the plurality of fins from the projectile body through the spinning generated by launch of the projectile.

BACKGROUND OF THE INVENTION

Certain large bore projectiles, such as artillery shells and recoilless rifle bullets fired from gun systems or rocket propelled grenades, missiles and rockets fired from tube launchers, typically comprise radially extending fins that are sized to be loaded within the gun barrel of the artillery system or tube launcher. The fins stabilize the projectile in flight maintaining the alignment of the projectile with the aimed trajectory. Many large bore projectiles also include a rocket motor or similar means for self-propelling the projectile or supplementing the primary propellant means for the projectile. With these projectiles, the fins are a necessary feature that prevents the self-propelled projectile from veering off course due to the thrust generated by the motor or the propellant means.

The inherent challenge with finned projectiles is positioning the fins such that they extend radially outward past the outer diameter of the main projectile body during flight to maximize the engagement of the fins to the air as the projectile flies while still fitting the projectile within the gun barrel or tube. A contravening concern is engaging the larger exterior surface of the projectile body to the gun barrel or tube allows the barrel or tube to more efficiently aim the projectile than with the smaller surface area provided by the tips of the fins. Fixed fins create a tradeoff between superior aerodynamic qualities of fins that extend beyond the outer diameter of the primary projectile body and the superior accuracy of sizing the projectile body to engage the barrel or tube. Accordingly, many finned projectiles comprise deployable fins that retract prior to firing to allow the projectile body to engage the barrel or tube and deploy upon exiting the barrel or tube to extend radially outward past the outer diameter of the projectile body.

Deployable fin projectiles typically comprises a main projectile body that engages the walls of the barrel or tube to axially align the projectile with the barrel or tube and engage the projectile to the rifling of the barrel when fired from a gun system. Prior to firing, the fins are retracted behind or hidden within the projectile body such that the projectile body defines the maximum outer diameter of the projectile. Upon leaving the barrel or tube, the fins deploy radially outward from behind or within the projectile body to engage the air. The projectiles typically comprise mechanical assemblies having springs or other similar biasing means that retain the fins in the retracted position during loading and deploy the fins as the projectile leaves the barrel or tube.

As both fixed and deployed fins are typically positioned at the rear of the projectile to maximize the aerodynamic advantage of the fins, the mechanical assemblies for deploying the fins are also positioned at the rear of the projectile and thereby proximate to any initial propellant charge for firing the projectile from guns. The heat and pressure from the ignited propellant gases can damage the mechanical assemblies resulting in failure of the mechanical assemblies to deploy or fully deploy the fins. In addition, the rapid acceleration of the projectile coupled with the heat and pressure can also cause the mechanical systems to fail.

Similarly, many tube launched rocket assisted projectiles have starter motors or propellant charges that launch the projectile from the tube before the primary motor ignites. The starter motor or propellant charge can also damage the mechanical fin deployment assemblies. Similarly, the mechanical fin deployment assemblies can often comprise additional assemblies for synchronizing deployment of the fins. The additional synchronization systems further increases the likelihood that some or all of the fins will fail to deploy as a result of damage during firing.

Although the mechanical assembly can be shielded to reduce the likelihood that the mechanical assemblies will be damaged during launch, the shielding increases the weight and bulk of the projectile. As the chamber of the gun or the tube launcher is fixed volume governed by the caliber of the projectile or standard missile or rocket size, any additional bulk to any portion of the projectile, such as from increased shielding, must result in a corresponding reduction in size in another portion of the projectile. Specifically, the additional shielding often reduces the possible projectile volume allotted to the projectile motor and/or payload.

Similarly, the fins themselves can reduce the size of the projectile volume allocated to the motor or payload or alter the shape of the projectile. As depicted in U.S. Pat. No. 4,334,657 and U.S. Pat. No. 7,083,141, the fins typically scissor between the retracted position and deployed position within a single plane transverse to the central axis of the projectile to minimize any potential disturbance to the trajectory of the projectile from the deploying fins. However, the scissoring of the fins into the projectile reduces the internal space of the projectile that can be allocated for the payload or the motor or creates an irregularly shaped space within the projectile. The reduction in motor size and/or payload reduces the range and overall effectiveness of the projectile.

The inherent tradeoff between preserving the mechanical function of the fin deployment mechanisms and reducing the performance of the projectile creates a need for a means of consistently deploying the fins without reducing the projectile volume allocated to the payload, primary motor or other projectile systems.

SUMMARY OF THE INVENTION

A projectile, according to an embodiment of the present invention, comprises a projectile body and a fin deployment system positioned against the rear of the projectile body and having a plurality of fins rotatable along a rotational axis parallel to and offset from the central axial axis of the projectile body. Each fin is rotatable around the rotational axis between a retracted position and a deployed position. Each offset rotational axis is proximate to the exterior of the projectile body such that each fin can be rotated into the retracted position, wherein the fin is generally aligned with or contoured to follow the exterior of the projectile body when positioned in the retracted position. In this configuration, the projectile body provides the primary engagement surface that aligns the projectile with the barrel or tube, while the fins do not or minimally engage the barrel or tube as the projectile travels through the barrel or tube. The fins are deployed by rotating the fin around the offset rotational axis until the fins are positioned within a plane transverse to the central axis of the projectile. In this configuration, the fins are positioned around an internal space aligned with central axis rather than scissoring into the internal space as with conventional fins that rotate within the plane transverse to the central axis. The exterior arrangement allows for more efficient use of the internal space that can contain additional payload, the motor or other features of the projectile.

In one aspect, the fin deployment system can comprise a cylindrical mount assembly defining a plurality of axial channels each aligning with the offset rotational axis of a corresponding fin. In this configuration, each fin comprises a fin portion and a barrel portion at one end of the fin portion and rotatable within the channel between the retracted position and the deployed position. During firing, the centrifugal force created by the rotation of the projectile from the barrel rifling causes the fin to rotate within the channel to move the fin portion from the retracted position in which the fin portion is generally aligned with the exterior of the projectile body to the deployed in which the fin extends radially outward from the central axis of the projectile. The reliance on the rotation of the projectile to extend the fins rather than mechanical assemblies reduces the likelihood that the pressure and heat of the launch will damage the fin deployment system resulting in unopened fins or lopsided fin deployment. Similarly, as the centrifugal forces act equally on each of the fins, fins are deployed together without the aid of synchronization systems. The lack of complex fin deploying mechanical assemblies reduces the potential systems that could fail during launch and also minimizes the amount of space that must be allocated for the deployment system, thereby freeing additional space for a motor or additional payload.

In one aspect, the projectile further comprises a fin cover positioned over the fins when positioned in the retracted position to facilitate loading of the projectile without accidental deployment of the fins during handling of the projectile. The fin cover engages each fin to prevent rotation of the barrel within the channel until the fin cover is removed. In one aspect, the fin cover further comprises inwardly indented portions for engaging the fins to prevent rotation of the fins. As the projectile exits the barrel, aerodynamic drag separates the fin cover from the projectile allowing the centrifugal force of the rotating projectile to rotate the fins into the extended position. The separable cover provides a means of unlocking the fins for deployment with a low probability of failure and relatively immune to the heat and pressure created by the ignited propellant charge. Moreover, unlike conventional deployment systems where the fins are typically biased to open and the cover is fitted to the projectile to restrain the fins, the fins of the present invention do not apply any outward bias apart from the centrifugal forces created by the rotation of the projectile generally. The unbiased fins reduce the friction between the fins and the cover, thereby reducing the likelihood that the cover will become stuck to the projectile and fail to separate from the projectile.

In one aspect, the fin cover can comprise at least one vent for equalizing the pressure of any air contained within the fin cover with atmospheric pressure as the projectile leaves the barrel or tube launcher. The propellant charge or starter motor can substantially increase the pressure proximate to the fin deployment system within the barrel or tube launcher. Upon exit of barrel, the air pressure around the fin deployment system rapidly decreases as the propellant gases dissipate and the projectile accelerates through "clean" air. The rapid depressurization of the surrounding air pressure without a correspondingly rapid depressurization of air within the fin cover can cause the fin cover to burst or otherwise damage the mechanical assemblies of the fin cover. The vents prevent high pressure air pockets from forming within the fin cover.

In one aspect, the fin deployment system can further comprise a locking ring defining a plurality of engagement surfaces corresponding to each of the axial channels. In this configuration, the barrel portion of the fin can comprise a protrusion or define a cutout that is rotated into engagement with the stop when the fin is rotated into the deployed position. The stop protrusion is positioned to engage the fin portion and stop the rotation of the fin when the fin portion is positioned in a plane transverse the central axis of the projectile, thereby preventing over rotation of the fin portion and maintaining the proper spacing of the deployed fins.

In one aspect, each fin can comprise a drive axle extending through the barrel of the fin, wherein the locking ring defines a first plurality of ports each corresponding to one of the plurality of axial channels and adapted to rotatably receive one end of the drive axle. Similarly, in one aspect, the fin deployment assembly can further comprise secondary ring positioned opposite the locking ring against the opposite end of the cylindrical mount assembly. The secondary ring defines a second plurality of ports each corresponding to one of the plurality of axial channels and adapted to rotatably receive the opposite end of the drive axle. In this configuration, the locking ring and secondary ring cooperate to maintain the barrel portion of each fin within the corresponding axial channel. In another aspect, the cylinder mount assembly can comprise a flared portion at one end defining the second plurality of ports for receiving the corresponding end of the drive axle.

In one aspect, the barrel of each fin can define a cutout portion providing an engagable locking surface. In this configuration, each axial channel defines a groove that aligns with the cut out portion when the barrel is rotated into the deployed position. The cylinder mount further comprises a locking tab with a corresponding spring positioned within each groove. Upon rotation of the fin into the deployed position and the alignment of the cutout portion with the groove, the spring is biased to push the locking tab out of the groove such that locking tab at least partially protrudes from the groove and engages the locking surface to prevent the fin from rotating back to the retracted position. In one aspect, the locking tab and stop protrusions of the locking ring cooperate to maintain the fin in the deployed position.

A projectile, according to an embodiment of the present invention, can comprise a projectile body and a fin deployment system. The fin deployment system can further comprise a plurality of fins and a cylindrical mount assembly. Each fin further comprises a fin portion and a barrel positioned at one end of the fin portion such that rotation of the barrel rotates the fin portion around the rotational axis of the barrel. The cylindrical mount assembly defines a plurality of axial channels each corresponding to one of the fins and adapted to rotatable receive the barrel of the corresponding fin. In operation, the barrel portion is rotatable with the axial channel to rotate the fin portion before a retracted position in which the fin portion is generally aligned with the exterior of the projectile body and a deployed position in which the fin portion is aligned with a plane transverse to the central axial axis of the projectile body. The barrel portion is rotated between the retracted position and the extended position by the rotational of the projectile.

In operation, a projectile, according to an embodiment of the present invention, is loaded into a gun such that the fin deployment system is positioned proximate to a propellant charge at the breech end of the barrel of the gun. Upon ignition of the propellant charge, the projectile is accelerated through the barrel by the expanding propellant gases. In one aspect, the projectile body engages the rifling of the barrel to impart spin to the projectile. The rotation of the projectile imparted by the rifling of the barrel creates centrifugal forces causing the barrel of each fin to rotate the fin portion until the fin portion extends axially outward from the central rotational axis of the projectile upon exiting the muzzle of the barrel. In one aspect, each fin can comprise a stop protrusion preventing further rotation of the fin portion once the fin portion has achieved the proper alignment with the central rotational axis. In addition, each fin can comprise a locking tab that extends from the cylindrical mount assembly to engage the barrel of each fin to prevent backwards rotation of the fin portion.

In operation, a projectile, according to an embodiment of the present invention, is loaded into a tube launcher. In one aspect, a motor can be positioned against or within the cylindrical mount assembly of the fin deployment system. The motor or a starter motor can be initially ignited to propel the projectile from the tube launcher. The motor can be adapted to direct the thrust stream at an angle to impart axial rotation to the projectile. Alternatively, the projectile body can comprise air scoops shaped to create axial rotation of the projectile. The rotation of the projectile imparted by the motor or air scoops creates centrifugal forces causing the barrel of each fin to rotate the fin portion until the fin portion extends axially outward from the central rotational axis of the projectile upon exiting the muzzle of the tube launcher. In one aspect, each fin can comprise a stop protrusion preventing further rotation of the fin portion once the fin portion has achieved the proper alignment with the central rotational axis. In addition, each fin can comprise a locking tab that extends from the cylindrical mount assembly to engage the barrel of each fin to prevent backwards rotation of the fin portion.

A method of deploying the fins from a tube or barrel launched projectile comprising mounting a plurality fins to a projectile body of the projectile, wherein the fins are rotatable along a rotational axis offset form the central axis. The method further comprises rotating the fins into a retracted position such the fins are generally aligned with the exterior of the projectile body. The method also comprises fitting a removable fin cover over a portion of each plurality of fins to maintain the fins in the retracted position. The method also comprises firing the projectile from a tube or barrel, wherein the barrel or tube rotates the projectile body around the central axial axis to extend the fins.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
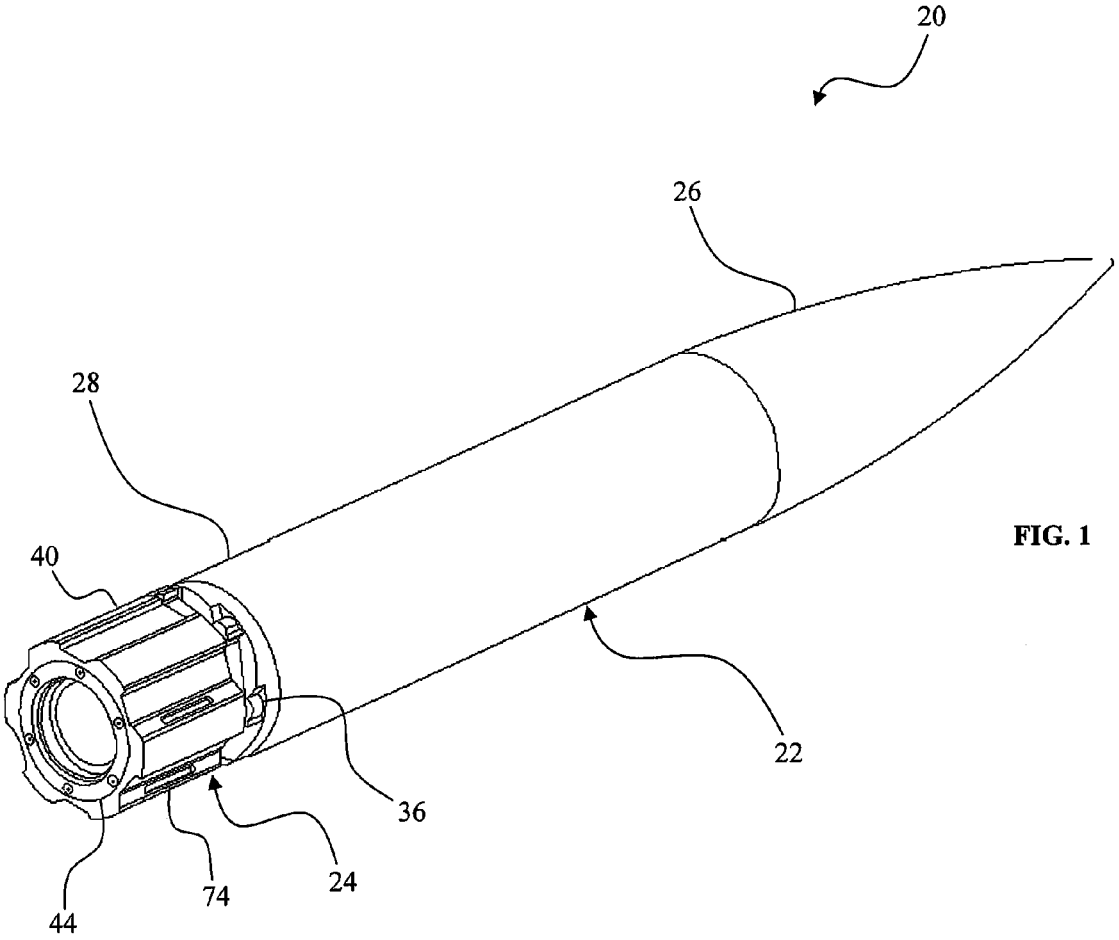
FIG. 1 is a perspective view of a projectile, according to an embodiment of the present invention, prior to fin deployment.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

Figure 3:
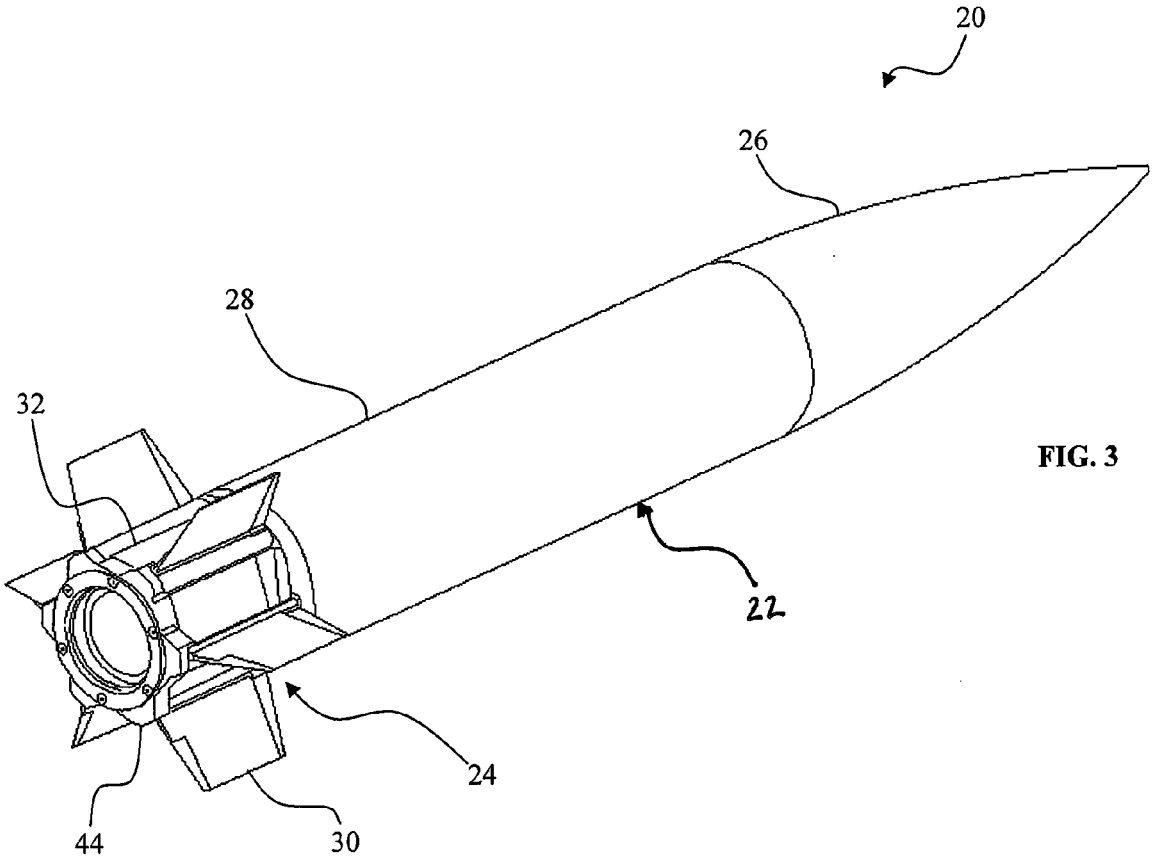
FIG. 3 is a perspective view of a projectile, according to an embodiment of the present invention, after fin deployment.

As depicted in FIGS. 1 and 3, a projectile 20, according to an embodiment of the present invention, comprises a projectile body 22 and a fin deployment system 24. The projectile body 22 further comprises an ogive tip portion 26 and a cylindrical end portion 28. The projectile body 22 defines a central axial axis extending between the tip portion 26 and the cylindrical end portion 28 and intersecting the tip of the tip portion 26. In one aspect, the cylindrical end portion 28 is sized to engage the barrel walls or the walls of the tube launcher to align the projectile 20 with the central axis of the barrel or tube launcher. In one aspect, the projectile body 22 can define an internal cavity for receiving ordinance and other payloads. As depicted in FIGS. 1 and 3, the fin deployment system 24 is positioned at the rear of the projectile body 22 against the cylindrical end portion 28.

Figure 2:
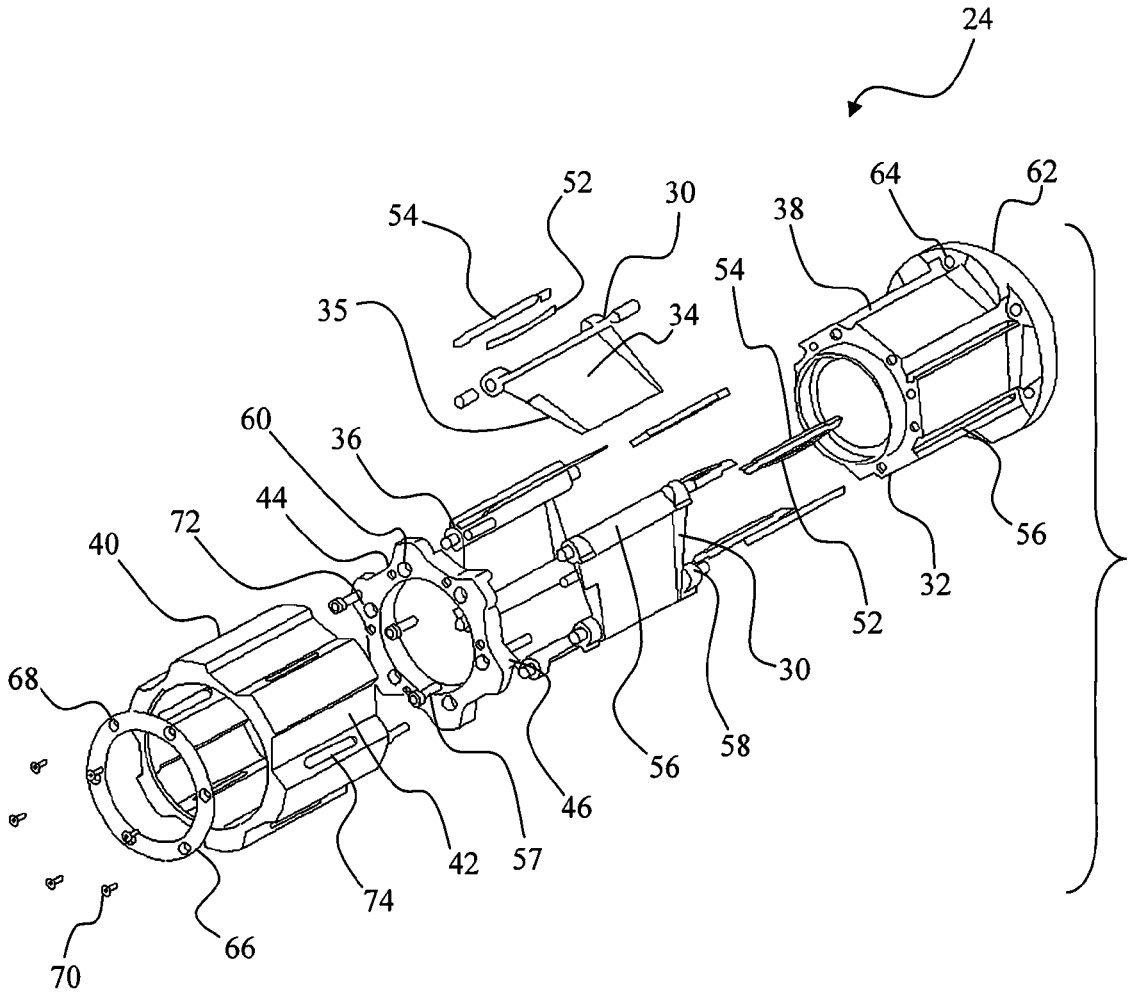
FIG. 2 is an exploded perspective view of a projectile according to an embodiment of the present invention.

As depicted in FIGS. 1-3, the fin deployment system 24 comprises a plurality of fins 30 and a cylindrical mount assembly 32. Each fin 30 further comprises a fin portion 34 and a barrel 36 positioned at one end of the fin portion 34 such that the barrel 36 can be rotated to rotate the fin portion 34 around the barrel 36. While fins 30 are depicted as flat in the attached drawings, it is envisioned that fins 30 may have a curvature to more closely fit the outer circumference of the projectile, or may be shaped with varying thickness depending upon expected flight dynamics. In one aspect, the fin portion 34 can comprise a cutout portion 35 angled to facilitate rotation of the projectile 20 in flight to facilitate continued rotation of the projectile 20 in flight after leaving the barrel or tube. The cylindrical mount assembly 32 similarly defines a plurality of axial channels 38 each corresponding to one of the plurality of fins 30 and adapted to rotatably receive the barrel 36 of each fin 30. Each channel 38 provides a bearing surface for allowing the barrel 36 for rotating within the channel 38 to move the fin portion 34 between the retracted and deployed positions. The channel 38 defines a rotational axis for barrel 36 that is parallel to, but offset from the central axial axis. In one aspect, the cylindrical mount assembly 32 defines an internal space that can be used to receive a rocket motor, additional ordinance or other payloads.

As depicted in FIGS. 2-4 and 6-8, each barrel 36 is rotatable to move the fin portion 34 between a retracted position and a deployed position. In the retracted position, the fin portion 34 is generally aligned with the exterior of the cylindrical end portion 28 such that plurality of fins 30 are arranged around the interior space defined by the mount assembly 32 when in the retracted position. In one aspect, the fins 30 are sized such that the tip of each fin portion 34 is proximate to the barrel 36 of the next fin 30 and no portion of the fin portion 34 protrudes past the outer diameter defined by the projectile body 22. In this configuration, the cylindrical end portion 28 provides the primary engagement between the projectile 20 and the barrel or tube that aligns the central axis of the projectile body 22 with the central axis of the barrel or tube. In the deployed position, each fin portion 34 is positioned within a plane transverse to the central axis of the projectile body 22. Similarly, a portion of the fin portion 34 extends beyond the outer diameter of the projectile body 22 to better engage the air in flight.

The rotation of the fin portions 34 between the retracted position and the deployed position is facilitated by the centrifugal force created by the rotation projectile 20 as the projectile 20 leaves the barrel or tube. The rotation can be facilitated by the barrel rifling, shaped air scoops in the tip 26, angling of the starter motor nozzles and other conventional means of imparting spin to the projectile 20 as the projectile 20 travels through the barrel or tube. Unlike conventional fin deployment systems, the present fin deployment system 24 deploys the fins 30 without any mechanical assembly, such as a spring or lever, and relies on the natural or created rotation of the projectile 20 to deploy the fins 30, thereby reducing the risk that fins 30 will fail to deploy due to mechanical failure or damage.

Figure 4:
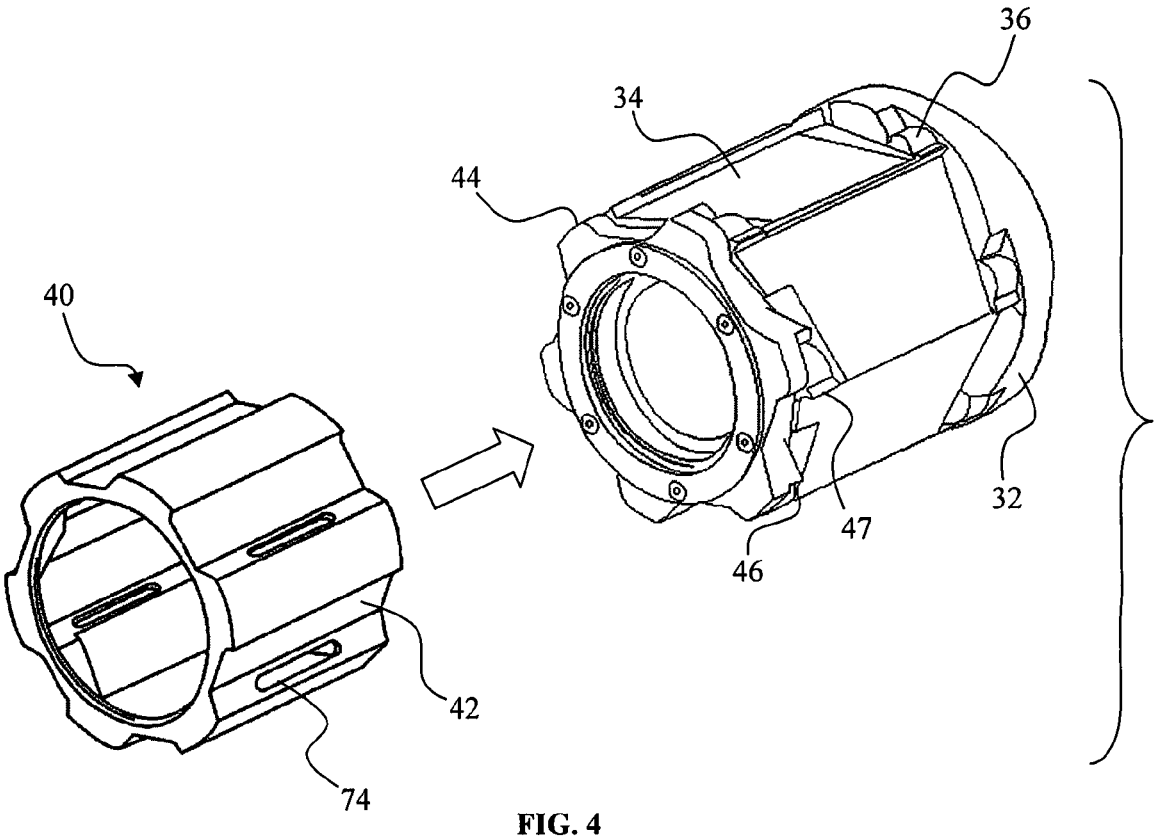
FIG. 4 is an exploded perspective view of a fin cover and a fin deployment system, according to an embodiment of the present invention, prior to fin deployment.
Figure 5:
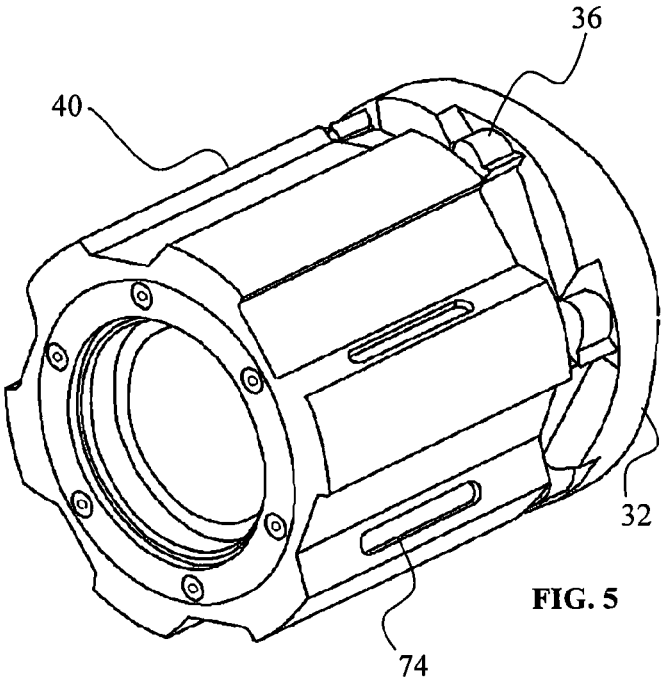
FIG. 5 is a perspective view of a fin cover and a fin deployment system assembly, according to an embodiment of the present invention, prior to fin deployment.
Figure 6:
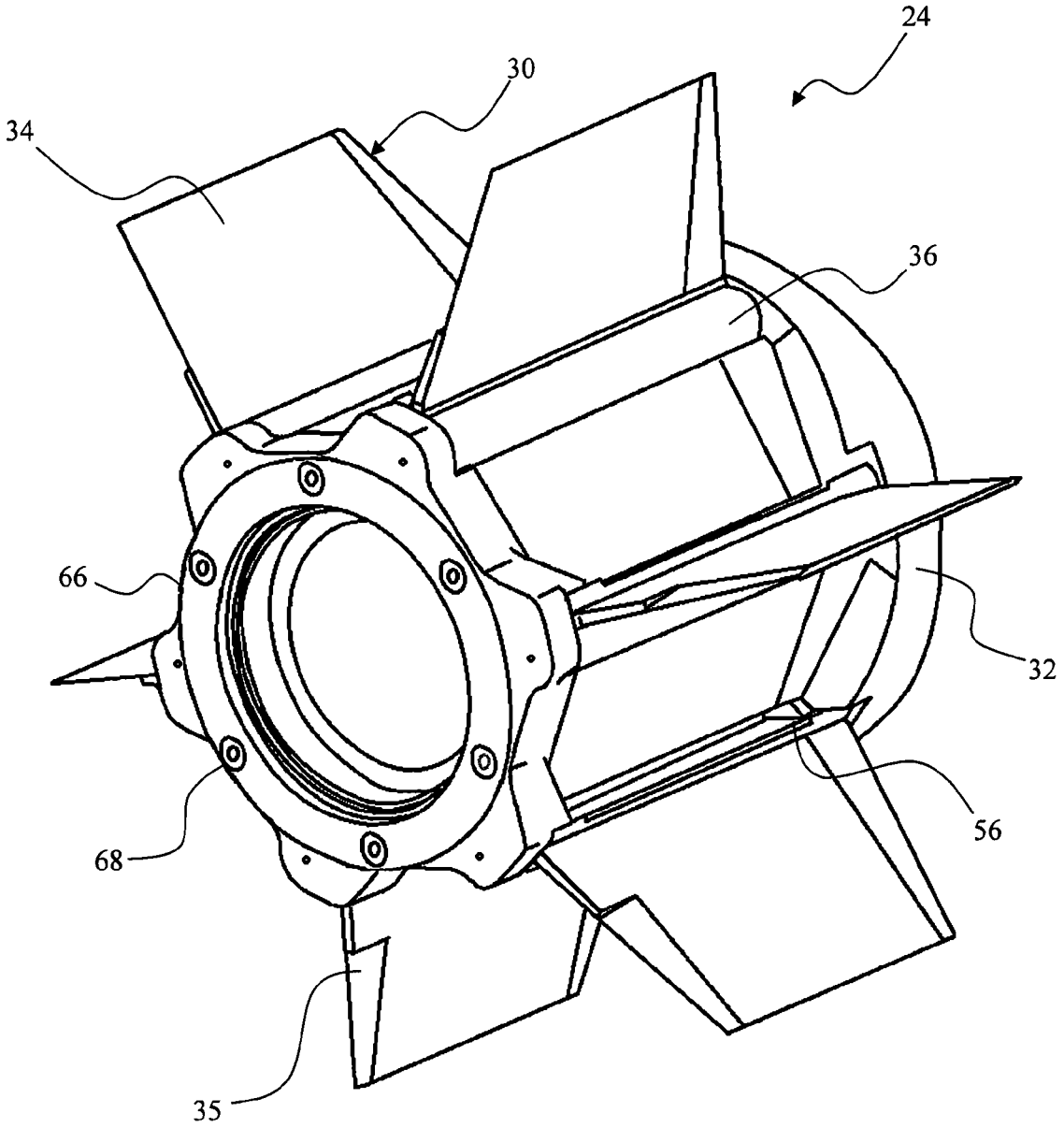
FIG. 6 is a perspective view of a fin deployment system after fin deployment according to an embodiment of the present invention.

As depicted in FIGS. 4-5, in one aspect, the fin deployment system 24 can further comprise a fin cover 40 positionable over the fins 30 and the mount assembly 32. The fin cover 40 further comprises plurality of indented portions 42 that engage the fin portions 34 to maintain the fin portions 34 in the retracted position as the projectile 20 travels through the barrel or tube. The fin cover 40 separates from the fins 30 and the mount assembly 32 as the projectile 20 exits the barrel or tube allowing the fins 30 to rotate into the deployed positions. In one aspect, the fin cover 40 is retained by a friction fit such that the drag caused by the air as the projectile 20 leaves the barrel or tube overcomes the friction fit and separates the fin cover 40 from the projectile 20. In one aspect, a portion of the fin deployment system 24 can engage the barrel or tube to assist the projectile body 24 in maintaining the alignment of the projectile 20 to the barrel or tube. In one aspect, the fin cover 40 can comprise a plurality of vents 74 that equalize the air pressure within the fin cover 40 with the surrounding air pressure to avoid formation of high pressure air pockets beneath the fin cover 40. As depicted in FIGS. 4-5, the vents 74 can be positioned within the indented portions 42 to prevent the edges of the vent 74 from engaging the rifling of the barrel or otherwise impacting the flight of the projectile.

Figure 7:
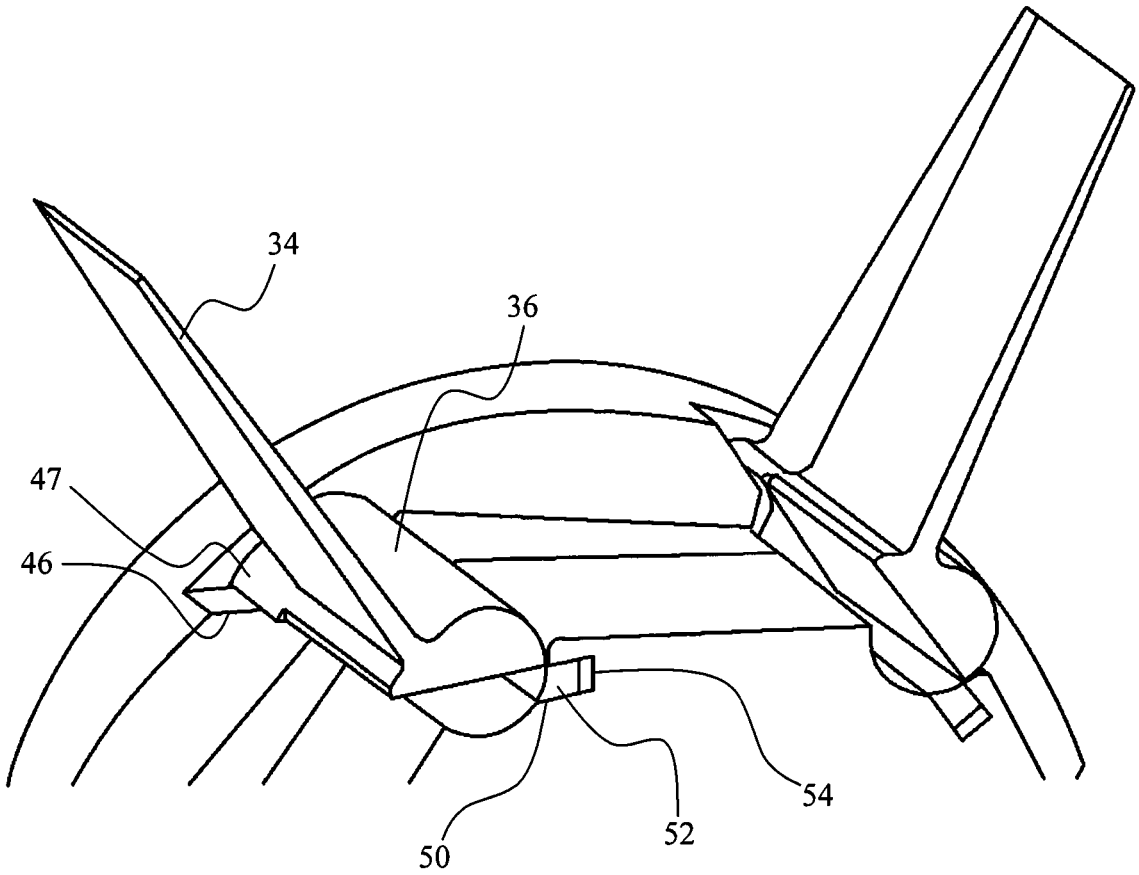
FIG. 7 is a partial cross-sectional view of a fin deployment system prior to fixation of the fins in the deployed position.
Figure 8:
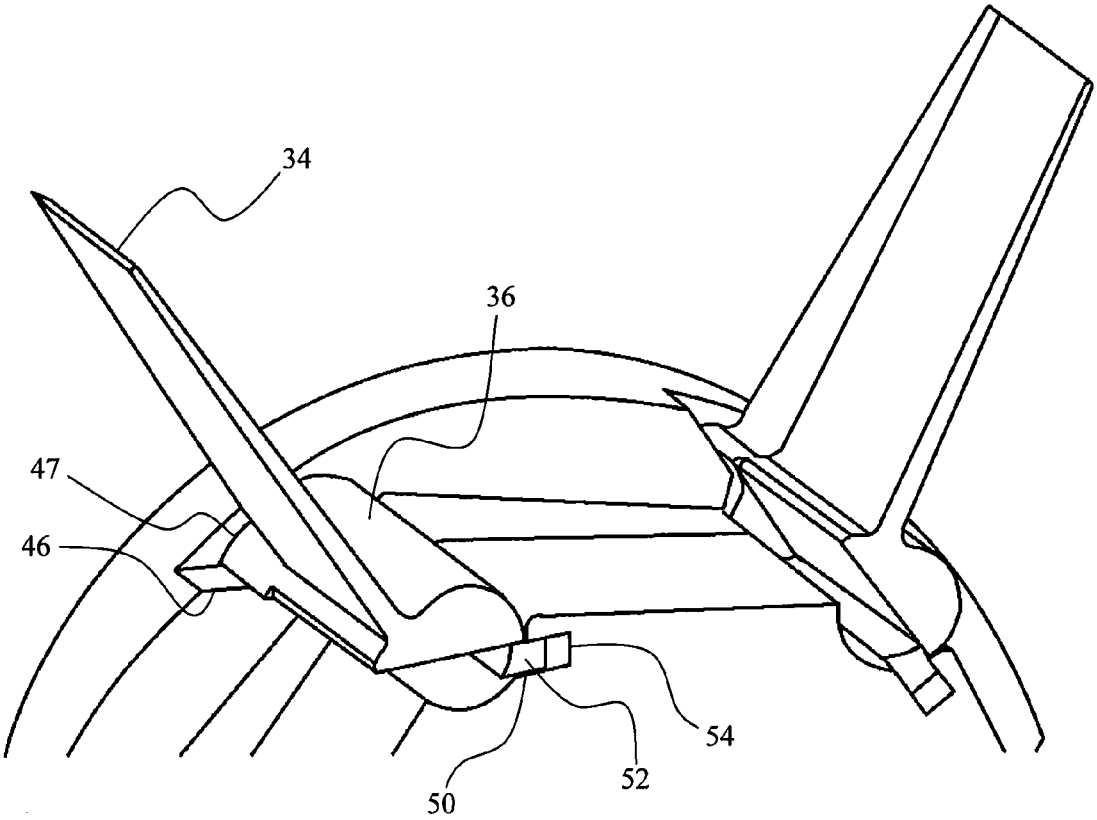
FIG. 8 is a partial cross-sectional view of a fin deployment system after fixation of the fins in the deployed position.

As depicted in FIGS. 7-8, in one aspect, the fin deployment system 24 can further comprise a locking ring 44 affixed to an end of the mount assembly 32. The locking ring 44 defines a plurality of engagement surfaces 46 each corresponding to one of the axial channels 38 and positioned to engage the fin portion 34 as the fin portion 34 is rotated into the deployed position. In this configuration, each barrel 36 comprises at least one stop protrusion 47 that engages the engagement surfaces 46 to prevent the fin portion 34 from over-rotating past the deployed position. In one aspect, the locking ring 44 can define a plurality of ports 48 for receiving a plurality of fasteners 50 for securing the locking ring 44 to the mount assembly 32.

As depicted in FIGS. 7-8, in one aspect, each barrel 36 can define a cutout portion providing a locking surface on the barrel 36. In this configuration, the mount assembly 32 defines a groove 50 that aligns with the locking surface of the barrel 36 when the fin portion 34 is positioned in the extended position. The mount assembly 32 further comprises a locking tab 52 and a flat spring 54 positioned within the groove 50. The flat spring 54 biases the locking tab 52 against the barrel 36. The barrel 36 retains the locking tab 52 within the groove 50 until the engagement surface aligns with the groove 50 at which point the locking tab 52 is free to be pushed by the spring 54 from the groove 50. The locking tab 50 engages the engagement surface to prevent the rotation of the fin portion 34 back to the retracted position after the fin portion 34 is rotated into the extended position. The locking tab 50 and the stop protrusion 46 to maintain the fin portion 34 in the deployed position.

As depicted in FIG. 2, in one aspect, each fin 30 further comprises a drive axle 56 extending axially through the barrel 36. The barrel 36 can further comprise at least one loop 58 for receiving the drive axle 56. As depicted in FIG. 2, each fin 30 comprises two drive axles 56 each extending from one end of the barrel 36. In this configuration, the locking ring 44 defines a first plurality of ports 60 for rotatably receiving one end of the drive axle 56. In one aspect, the locking ring 44 can further comprise a plurality of fasteners 57 for securing the end of the drive axle 56 within the first plurality of ports 60. In one aspect, the mount assembly 32 further comprises a flared portion 62 defining a plurality of second plurality of ports 62 for rotatably receiving the opposite end of the drive axle 56. The first and second plurality of ports 60, 64 cooperate to maintain the barrel 36 in the axial channel 38 as the barrel 36 rotates the fin portion 34 between the retracted position and the extended position. In one aspect, the flared portion 62 can further comprise a second plurality of stop protrusions 64 for engaging the fin portion 34 and preventing over-rotation of the fin portion 34 past the deployed position.

As depicted in FIG. 2, in one aspect, the cylindrical mount assembly 32 can further comprise a protector plate 66 shielding the ends of the drive axles 56 from damage from the heat and pressure generated during firing. The protector plate 66 can define a plurality of ports 68 for receiving corresponding fasteners 70 to secure the protector plate 66 to a corresponding plurality of ports 72 defined by the locking ring 44.

According to an embodiment of the present invention, in operation, a projectile 20 can be loaded into a gun barrel or a tube launcher such that the tip portion 26 of the projectile 20 is oriented toward the muzzle of the barrel or tube launcher. In a gun launch, a propellant charge can be placed behind the fin deployment system 24. In a tube launch, a motor can be placed within the cylindrical mount assembly 32 or behind the fin deployment system 24. In one aspect, the fin cover 40 can be positioned over the fins 30 to retain the fins 30 in the retracted position while the projectile 20 is in the barrel or tube launcher.

During firing, the propellant gases generated by the ignited propellant charge or the thrust generated by the launch motor accelerate the projectile 20 through the gun barrel or tube launcher. In a gun launch, the rifling of the barrel engages the projectile body 22 to impart spin to the projectile 20. In a tube launch, the motor can be aimed to impart a spin to the projectile 20 as the projectile 20 travels through the tube launcher and through the air. Similarly, the tip portion 26 of the projectile body 22 can comprise air scoops shaped to cause axial rotation of the projectile 20 in flight.

Upon exiting the muzzle of the tube or barrel, the vents 74 in the fin cover 40 rapidly equalize the pressure within the fin cover 40 with the surrounding air. Aerodynamic drag on the fin cover 40 slows and separates the fin cover 40 from the fin deployment system 24. The axial rotation of the projectile 20 causes the now freed fin portions 34 to rotate into the deployed positions in response to the centrifugal forces created by the rotation of the projectile 20. The fin portions 34 continue to rotate until the barrel 36 engages the stop protrusion 46 preventing further rotation of the fin portion 34. Similarly, a locking tab 52 is then deployed from the cylindrical mount assembly 32 to engage the barrel 36 and prevent backwards rotation of the fin portion 34.

While the invention is amenable to various modifications and alternative forms, specifics thereof have been shown by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The invention claimed is:

1. A fin deployment system for a projectile comprising a plurality of fins rotatable along a rotational axis parallel to and offset from the central axial axis of a projectile body, wherein each fin is rotatable around the rotational axis between a retracted position and a deployed position, rotation to the deployed position occurs only from the centrifugal forces generated by the spinning of the projectile;

a cylindrical mount assembly defining a plurality of axial channels each aligning with the offset rotational axis of a corresponding fin; said cylindrical mount assembly having a solid interior face for defining a central opening and wrapping around the circumference of the aft end of the projectile so that the cylindrical mount assembly remains independent of the projectile;

a fin cover positioned over the fins and cylindrical mount assembly when the fins are positioned in the retracted position, and wherein the fin cover slidably engages the cylindrical mount so that as the projectile exits a tube or a gun barrel, aerodynamic drag separates the fin cover from the projectile; said fin cover having a tubular shape so as not to block the aft end of the projectile; and wherein said fin cover completely covers each fin to prevent rotation of the barrel within the axial channel until the fin cover is removed and the fin cover includes axial indentations on an outer face for placement of a vent to equalize the pressure between the fin cover and the cylindrical mount assembly during operation.

2. The fin deployment system of claim 1 wherein the offset rotational axis is proximate to the exterior of the projectile body such that each fin can be rotated into the retracted position, wherein the fin is generally aligned with or contoured to follow the exterior of the projectile body when positioned in the retracted position.

3. The fin deployment system of claim 1 wherein each fin comprises a fin portion and a barrel portion at one end of the fin portion and rotatable within the axial channel between the retracted position and the deployed position.

4. The fin deployment system of claim 3 wherein the fin deployment system can further comprise a locking ring defining a plurality of engagement surfaces corresponding to each of the axial channels.

5. The fin deployment system of claim 4 wherein each fin can comprise a drive axle extending through the barrel of the fin, wherein the locking ring defines a first plurality of ports each corresponding to one of the plurality of axial channels and adapted to rotatably receive one end of the drive axle.

6. The fin deployment system of claim 5 wherein the fin deployment assembly can further comprise a secondary ring positioned opposite the locking ring against an opposite end of the cylindrical mount assembly, said secondary ring defines a second plurality of ports each corresponding to one of the plurality of axial channels and adapted to rotatably receive the opposite end of the drive axle.

7. The fin deployment system of claim 3 wherein the barrel portion of the fin can comprise a protrusion or define a cutout that is rotated into engagement with a stop protrusion when the fin is rotated into the deployed position, said stop protrusion is positioned to engage the fin portion and stop the rotation of the fin when the fin portion is positioned in a plane transverse the central axis of the projectile, thereby preventing over rotation of the fin portion and maintaining a proper spacing of the deployed fins.

8. The fin deployment system of claim 3 wherein the barrel of each fin can define a cutout portion providing an engagable locking surface so that each axial channel defines a groove that aligns with the cutout portion when the barrel is rotated into the deployed position.

9. The fin deployment system of claim 8 wherein the cylindrical mount assembly further comprises a locking tab with a corresponding spring positioned within each groove so that upon rotation of the fin into the deployed position and the alignment of the cutout portion with the groove, the spring is biased to push the locking tab out of the groove such that locking tab at least partially protrudes from the groove and engages the locking surface to prevent the fin from rotating back to the retracted position.

10. The fin deployment system of claim 1 wherein the fin cover can comprise at least one vent for equalizing the pressure of any air contained within the fin cover with atmospheric pressure as the projectile leaves the barrel or tube launcher.

11. A projectile comprising a projectile body and a fin deployment system, said fin deployment system comprising;

a plurality of fins;

a cylindrical mount assembly having a tubular shape with an outer surface and an inner surface, the inner surface being a uniform face without need for openings or interaction with the projectile body, wherein each fin further comprises a fin portion and a barrel positioned at one end of the fin portion such that rotation of the barrel rotates the fin portion around the rotational axis of the barrel, the rotation of the fins created only by the centrifugal force of the rotating projectile;

wherein the outer face of the cylindrical mount assembly defines a plurality of axial channels each corresponding to one of the fins and adapted to rotatably receive the barrel of the corresponding fin; and a fin cover positioned completely over the fins, said fin cover having a tubular shape and slidably engaging the cylindrical mount assembly, said fin cover separating from the fin deployment system due to aerodynamic forces experienced by the fin cover after launch from a gun barrel or tube;

wherein said fin cover completely covers each fin to prevent rotation of the barrel within the axial channel until the fin cover is removed and the fin cover includes axial indentations on an outer face for placement of a vent to equalize the pressure between the fin cover and the cylindrical mount assembly during operation.

12. A method of deploying a plurality of fins from a tube or barrel launched projectile, the method comprising:

mounting a cylindrical mount assembly about the circumference of the aft end of the projectile, said cylindrical mount assembly including a plurality of fins, wherein the fins are rotatable along a rotational axis offset from a projectile central axis, the cylindrical mount assembly including all the necessary structure for maintaining and rotating the fins to a deployed position so as not to require structure within the projectile;

rotating the fins into a retracted position such that the fins are generally aligned tangential with the exterior of the projectile body;

fitting a removable fin cover over the cylindrical mount assembly, said fin cover holding the plurality of fins in the retracted position, wherein said fin cover completely covers each fin to prevent rotation of the barrel within the axial channel until the fin cover is removed and the fin cover includes axial indentations on an outer face for placement of a vent to equalize the pressure between the fin cover and the cylindrical mount assembly during operation;

firing the projectile from a tube or barrel, wherein the barrel or tube rotates the projectile body around the central axis;

removing the fin cover after the projectile leaves the tube or barrel by aerodynamic forces experienced by the fin cover after launch from the tube or barrel; and deploying the fins by the rotation of the projectile.

13. The method of deploying a plurality of fins according to claim 12 further including locking the fins in a deployed position, wherein said deployed position is generally in a plane transverse the central axis of the projectile, said cylindrical mount assembly comprising the locking mechanism.

14. The method of deploying a plurality of fins according to claim 12 wherein aerodynamic drag separates the fin cover from the projectile.

15. The method of deploying a plurality of fins according to claim 12 wherein the fin cover includes at least one vent for equalizing the pressure of any air contained within the fin cover with atmospheric pressure as the projectile leaves the barrel or tube launcher.

16. The method of deploying a plurality of fins according to claim 12 wherein each fin comprises a fin portion and a barrel portion at one end of the fin portion and said fin rotatable between the retracted position and the deployed position.

17. The method of deploying a plurality of fins according to claim 16 wherein the rotation of the projectile imparted by the rifling of the barrel or tube creates centrifugal forces causing the barrel of each fin to rotate the fin portion until the fin portion extends axially outward from the central rotational axis of the projectile upon exiting the muzzle of the barrel.

18. The method of deploying a plurality of fins according to claim 12 further including rotating the projectile body by an air scoop shaped to create axial rotation of the projectile.

19. The method of deploying a plurality of fins according to claim 12 further including rotating the projectile body by angling a rocket exhaust, said rocket exhaust provided by a rocket disposed within the projectile body.

* * * * *